US007623072B2

(12) United States Patent
Feng et al.

(10) Patent No.: US 7,623,072 B2
(45) Date of Patent: Nov. 24, 2009

(54) MULTIBAND ANTENNA AND MULTIBAND ANTENNA SYSTEM

(75) Inventors: Zheng He Feng, Beijing (CN); Peng Sun, Columbus, OH (US)

(73) Assignee: Sanyo Electric Co., Ltd., Osaka (JP)

( * ) Notice: Subject to any disclaimer, the term of this patent is extended or adjusted under 35 U.S.C. 154(b) by 5 days.

(21) Appl. No.: 11/638,458

(22) Filed: Dec. 14, 2006

(65) Prior Publication Data

US 2007/0188388 A1 Aug. 16, 2007

(30) Foreign Application Priority Data

Dec. 14, 2005 (CN) ..... 2005 1 0129644

(51) Int. Cl.
*H01Q 1/38* (2006.01)

(52) U.S. Cl. ..... 343/700 MS; 343/702; 343/846

(58) Field of Classification Search ..... 343/700 MS, 343/702, 846

See application file for complete search history.

(56) References Cited

U.S. PATENT DOCUMENTS

| | | | | |
|---|---|---|---|---|
| 6,307,525 | B1 * | 10/2001 | Bateman et al. | 343/853 |
| 6,906,678 | B2 * | 6/2005 | Chen | 343/795 |
| 6,917,334 | B2 * | 7/2005 | Chen | 343/700 MS |
| 7,218,282 | B2 * | 5/2007 | Humpfer et al. | 343/700 MS |
| 7,233,289 | B2 * | 6/2007 | Chung et al. | 343/700 MS |

OTHER PUBLICATIONS

Jeun-Wen Wu et al., "A Planar Meander-Line Antenna For Triple-Band Operation Of Mobile Handsets", Microwave And Optical Technology Letters/ vol. 41, No. 5, Jun. 5, 2004, p. 380-386.

* cited by examiner

*Primary Examiner*—Hoang V Nguyen
(74) *Attorney, Agent, or Firm*—NDQ&M Watchstone LLP

(57) ABSTRACT

A multiband antenna includes an antenna portion having a front surface and a back surface and a ground plane located adjacent to the antenna portion. The multiband antenna includes a front surface side element arranged on the front surface side and connected to a feeding point. The back surface side element arranged on the back surface side and connected to the ground plane.

6 Claims, 6 Drawing Sheets

MULTIBAND ANTENNA AND MULTIBAND ANTENNA SYSTEM

CROSS REFERENCE TO RELATED APPLICATIONS

This application is based upon and claims the benefit of priority from prior Chinese Patent Application No. 200510129644.1; the entire contents of which are incorporated herein by reference.

BACKGROUND OF THE INVENTION

1. Field of the Invention

The present invention relates to a multiband antenna provided with multiple elements correspond to multiple resonance frequencies, and to a multiband antenna system.

2. Description of the Related Art

A conventional multiband antenna used in a mobile terminal has elements having different lengths from each other. The elements generate mutually different resonance frequencies, respectively. The elements have a multiple branch structure in which the multiple elements are branched off.

FIG. 1 is a view showing a monopole antenna 110. As shown in FIG. 1, the monopole antenna 110 is provided with a ground plane 111, an element 112, and a feeding point 113. The length of the element 112 is almost equal to a quarter of a designed wavelength. The element 112 has a spiral shape, a bent shape, a bent shape or the like so that an impedance of the element 112 can match an impedance of a feed line.

A current distribution of the element 112 is approximate to a sinusoidal distribution having a quarter cycle. The current distribution of the element 112 takes on a maximum value at the feeding point 113, while a voltage distribution of the element 112 takes on a minimum value at the feeding point 113.

FIG. 2 is a view showing a multiband antenna 120 having a multiple branch structure. As shown in FIG. 2, the multiband antenna 120 is provided with a ground plane 121, multiple elements 122 (an element 122A and an element 122B), and a feeding point 123. The element 122A and the element 122B share a common portion 124. The element 122A has a shape in which the element 122A is branched off from the common portion 124. The element 122B has a shape in which the element 122B is branched off from the common portion 124. The multiband antenna 120 can deal with two resonance frequencies by means of the element 122A and the element 122B.

FIG. 3 and FIG. 4 are views showing another multiband antenna 130 having a multiple branch structure. To be more precise, FIG. 3 is a view of the multiband antenna 130, which is viewed from a front surface side, and FIG. 4 is a view of the multiband antenna 130, which is viewed from a back surface side.

As shown in FIG. 3 and FIG. 4, the multiband antenna 130 is provided with a ground plane 131, multiple elements 132 (an element 132A, an element 132B, and an element 132C), a feeding point 133, and a short stub 137. The element 132A, the element 132B, and the element 132C share a common portion 134. The element 132A has a shape in which the element 132A is branched off from the common portion 134. The element 132B has a shape in which the element 132B is branched off from the common portion 134. The element 132C has a shape in which the element 132C is branched off from the common portion 134.

The multiband antenna 130 can deal with three resonance frequencies by means of the element 132A, the element 132B, and the element 132C.

Note that, the short stub 137 connects the common portion 134 and the ground plane 131 via a through hole 138, to achieve matching between the impedance of the element 132A and an impedance of a feed line. Meanwhile, a tip portion of the multiband antenna 130 is bent along a bending line in order to miniaturize the multiband antenna 130.

Here, considering a case where a resonance frequency of the element 122A and a resonance frequency of the element 122B approach each other in the multiband antenna 120 shown in FIG. 2, a length from the feeding point 123 to a tip of the element 122A is almost equal to a length from the feeding point 123 to the element 122B. In this case, a strong coupling occurs between the element 122A and the element 122B. Moreover, a current is distributed to a horizontal portion 125 which is branched off from the common portion 124.

Similarly, considering a case where a resonance frequency of the element 132B and a resonance frequency of the element 132C approach each other in the multiband antenna 130 shown in FIG. 3 and FIG. 4, a length from the feeding point 133 to a tip of the element 132B is almost equal to a length from the feeding point 133 to the element 132C. In this case, a strong coupling occurs between the element 132B and the element 132C. Moreover, a current is distributed to a horizontal portion 135 which is branched off from a branching point 136 of the common portion 134.

For this reason, a radiation pattern of the multiband antenna is altered when the current is distributed to the horizontal portions (the horizontal portion 125 or the horizontal portion 135). Specifically, the elements couples to each other, and the resonance frequencies of the respective elements do not meet designed frequencies.

The increasing in a size of the multiband antenna is conceivable to avoid the coupling between the respective elements. However, such an increase in the size of the multiband antenna is not favorable because the increase in the size of the multiband antenna leads to an increase in a size of the mobile terminal.

Therefore, in a case to provide the multiband antenna with the elements corresponding to multiple resonance frequencies while simultaneously attempting miniaturization of the multiband antenna, it is difficult to avoid the coupling between the respective elements.

Alternatively, it is also conceivable to slightly shift a position of branching off the elements from the common portion shared by the respective elements. However, this arrangement requires strict management of manufacturing errors of the multiband antenna. As a result, there is a risk of a drop in a yield rate of the multiband antenna.

SUMMARY OF THE INVENTION

An aspect of the present invention is to provide a multiband antenna (a multiband antenna 10) provided with an antenna portion (an antenna portion 11) having a front surface and a back surface and a ground plane (a ground plane 12) located adjacent to the antenna portion. The multiband antenna includes front surface side elements (an element 13A and an element 13B) arranged on the front surface side and connected to a feeding point (feeding point 15), and back surface side element (an element 13C) arranged on the front surface side and connected to the ground plane.

According to this aspect, the front surface side element and the back surface side element are provided on mutually different surfaces of the antenna portion. Therefore, even in a case where elements corresponding to multiple resonance frequencies are provided, coupling between the front surface side element and the back surface side element is suppressed, and thereby an excitation in a high order mode is suppressed.

Meanwhile, since the element is provided to the back surface side of the antenna portion, it is not necessary to strictly manage manufacturing errors of the multiband antenna. As a result, it is possible to suppress a drop in a yield rate of the multiband antenna.

Another aspect of the present invention is to provide the multiband antenna of the aspect described above, in which the front surface side element and the back surface side element share the feeding point.

Another aspect of the present invention is to provide the multiband antenna of the aspect described above, in which the front surface side elements are formed of multiple elements sharing a common portion connected to the feeding point, the back surface side element has a portion (a portion 21) provided along the common portion, and has a shape bent in a vicinity of a branching portion where the multiple elements are branched off from the common portion.

Another aspect of the present invention is to provide the multiband antenna of the aspect described above, in which the front surface side elements are formed of multiple elements sharing a common portion connected to the feeding point. The multiband antenna further includes a short stub (a short stub 14) branched off from the common portion and connected to the ground plane.

Another aspect of the present invention is to provide the multiband antenna of the aspect described above, in which the short stub is provided for achieving an impedance matching of the longest element out of the multiple elements.

Another aspect of the present invention is to provide the multiband antenna of the aspect described above, in which a tip portion of the antenna portion is bent.

An aspect of the present invention is to provide a multiband antenna system provided with the multiband antenna having one of the above-described aspects, and a multiplexer (a multiplexer 30) configured to achieve an impedance matching corresponding to an electromagnetic radiation received by the multiband antenna.

DESCRIPTION OF THE PREFERRED EMBODIMENT

Figure 1:
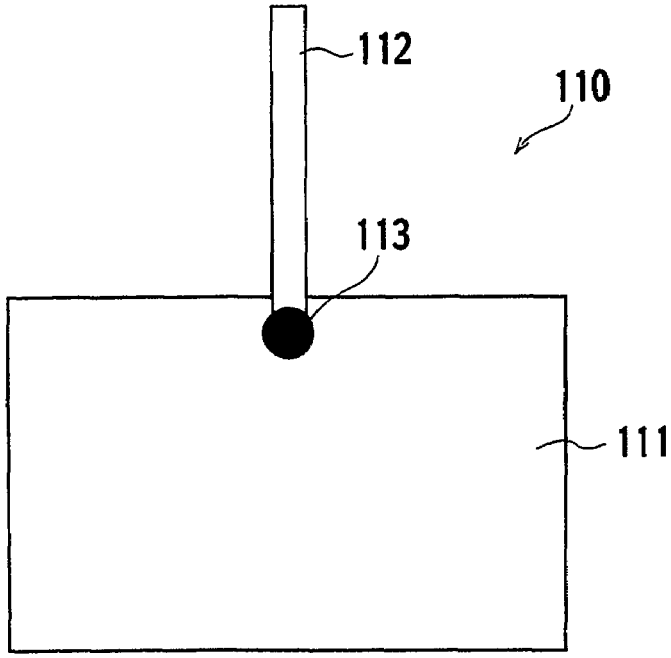
FIG. 1 is a view showing a configuration of a monopole antenna 110 according to the related art.
Figure 2:
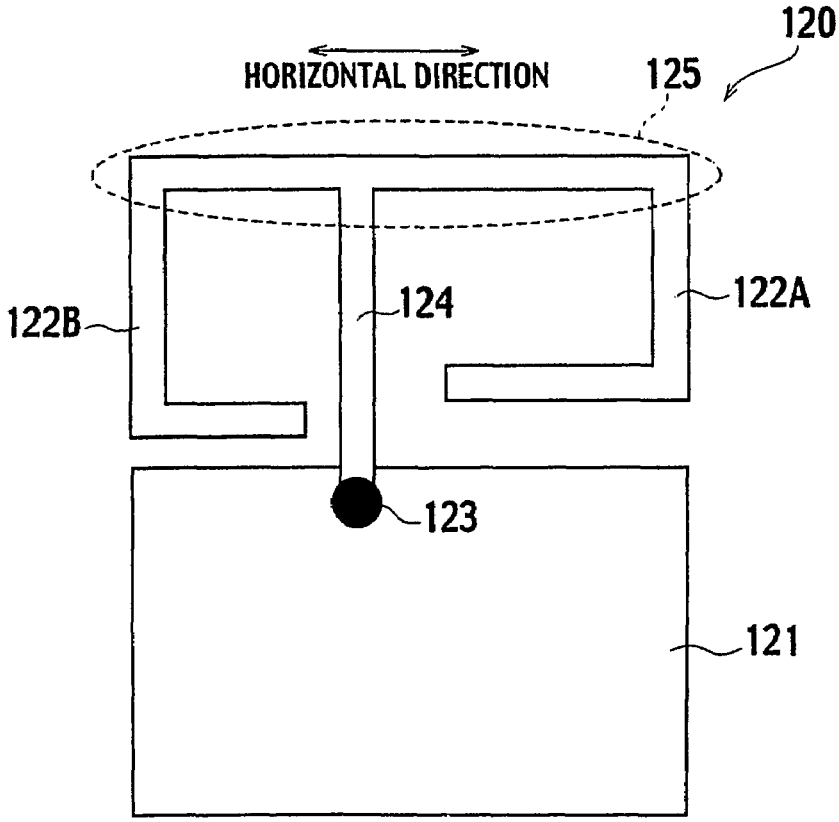
FIG. 2 is a view showing a configuration of a multiband antenna 120 according to the related art.

A multiband antenna according to an embodiment of the present invention will be described below with reference to the accompanying drawings. Note that, in the descriptions of the drawings, identical or similar portions are designated by identical or similar reference numerals.

It is to be noted, however, that the drawings are merely schematic and that dimensional proportions and the like are different from those of actual configurations, respectively. Therefore, concrete dimensions and the like should be determined in conformity to the following descriptions. Moreover, it is needless to say that portions which have different dimensional relationships and proportions from one another, are included among the accompanying drawings.

First Embodiment (Configuration of Multiband Antenna)

Figure 5:
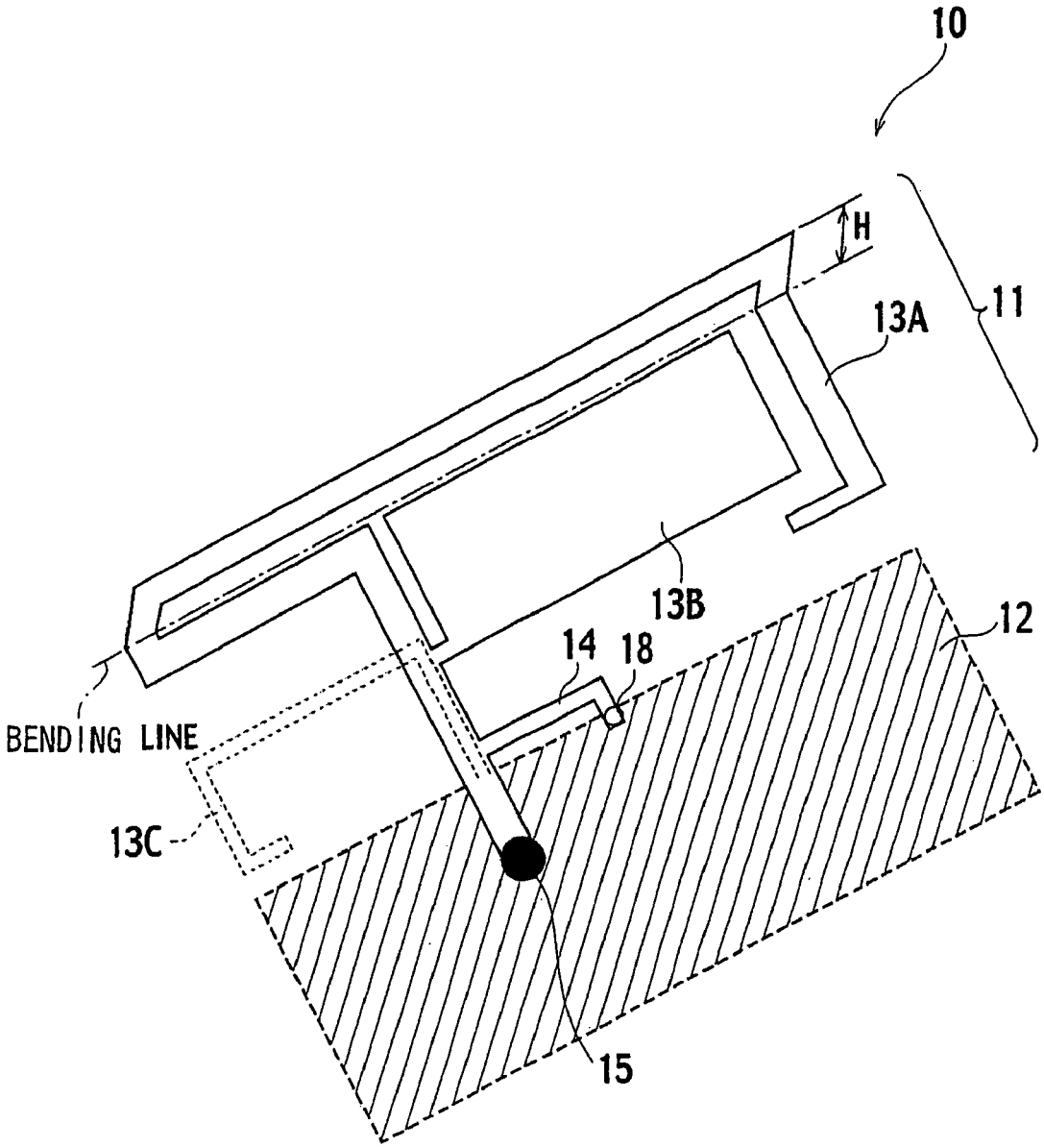
FIG. 5 is a perspective view showing a multiband antenna 10 according to a first embodiment.
Figure 6:
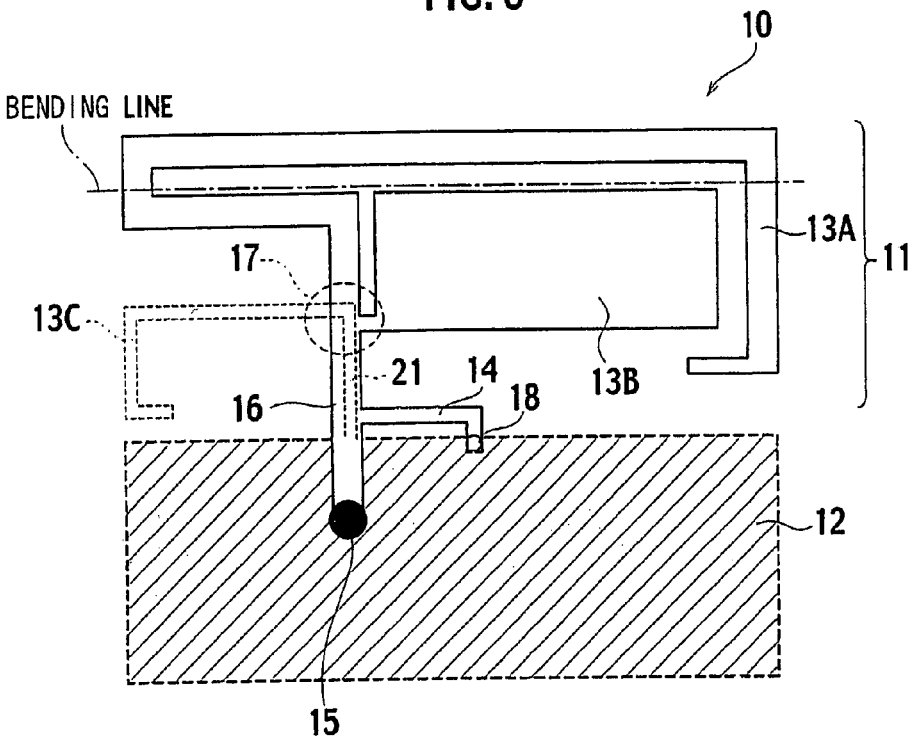
FIG. 6 is a view of the multiband antenna 10 according to the first embodiment, which is viewed from a front surface side.
Figure 7:
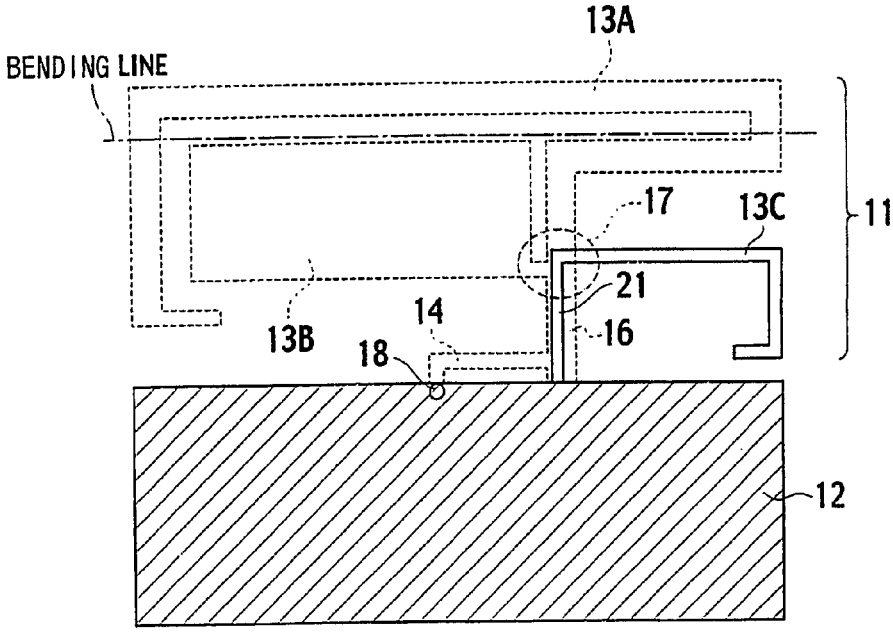
FIG. 7 is a view of the multiband antenna 10 according to the first embodiment, which is viewed from a back surface side.

A configuration of the multiband antenna according to a first embodiment of the present invention will be described below with reference to the accompanying drawings. FIG. 5 to FIG. 7 are views showing a multiband antenna 10 according to the first embodiment. To be more precise, FIG. 5 is a perspective view of the multiband antenna 10. FIG. 6 is a view of the multiband antenna 10, which is viewed from a front surface side, and FIG. 7 is a view of the multiband antenna 10, which is viewed from a back surface side.

As shown in FIG. 5 to FIG. 7, the multiband antenna 10 has an antenna portion 11 in which a front surface and a back surface are formed, and a ground plane 12 provided adjacent to the antenna portion 11. Multiple front surface side elements (an element 13A and an element 13B) connected to a feeding point 15, and a short stub 14 are arranged on the front surface side of the antenna portion 11. Meanwhile, a back surface side element (an element 13C) connected to the ground plane 12 is arranged on the back surface side of the antenna portion 11.

A feeding point 15 for supplying a current to the antenna portion 11 (the element 13A to the element 13C) is arranged on proper location of the front surface side corresponding to the ground plane 12. Note that, the feeding point 15 is electrically separated from the ground plane 13 by dielectric substance and the like.

The element 13A has the length about equal to a quarter of a designed wavelength (such as a designed wavelength corresponding to a GSM (which stands for Global System for Mobile communication) frequency (890 to 960 MHz)). The element 13B has the length almost equal to a quarter of designed wavelength (a designed wavelength corresponding to a DCS (which stands for Digital Communication System) frequency (1710 to 1880 MHz) and to a PCS (which stands for Personal Communication System) frequency (1850 to 1990 MHz)).

The element 13A and the element 13B share a common portion 16 which is connected to the feeding point 15. Specifically, the element 13A has a shape in which the element 13A is branched off from the common portion 16 at a branching portion 17, and the element 13B has a shape in which the element 13B is branched off from the common portion 16 at a branching portion 17. The short stub 14 is branched off from the common portion 16 and is connected to the ground plane 12 via a through hole 18.

Note that, the short stub 14 is preferably provided for achieving the impedance matching of the element 13A, which has the longest element length out of the element 13A and the element 13B. Specifically, the short stub 14 is preferably corresponds to the element having the longest designed wavelength.

The element 13C has the length almost equal to a quarter of a designed wavelength (such as a designed wavelength corresponding to a PCS frequency (1850 to 1990 MHz) and to an IMT2000 (which stands for International Mobile Telecommunication 2000) frequency (1920 to 2170 MHz)). The frequencies applied to the element 13C and the frequencies applied to the element 13B overlap each other. Therefore, a length from the feeding point 15 to a tip of the element 13C is approximate to a length from the feeding point 15 to a tip of the element 13B.

The element 13C has a portion 21 which is provided along the common portion 16 of the front surface side elements. The portion 21 of the element 13C is connected to the ground plane 12. Therefore, a direction of current flow on the portion 21 of the element 13C is opposite to a direction of current flow on the common portion 16 of the front surface side element.

That is, in case where the current from the feeding point 15 toward the element 13A and the element 13B flows on the common portion 16 of the front surface side element at time t, the current returning from the element 13C toward the ground plane 12 corresponding to the feeding point 15 flows on the portion 21 of the element 13C.

On the contrary, in case where the current returning from the element 13A and the element 13B toward the feeding point 15 flows on the common portion 16 of the front surface side element at time t+1 after time t, the current from the ground plane 12 corresponding to the feeding point 15 toward the element 13C flows on the portion 21 of the element 13C.

In the viewpoint described above, the element 13A to the element 13C are electrically connected to the feeding point 15, and share the feeding point 15.

The element 13C has a shape bent almost perpendicularly at the branching portion 17. Here, it is to be noted that the element 13C has the shape that extends in an opposite direction to the element 13B.

A tip portion of the antenna portion 11 is bent almost perpendicularly along a bending line. A height H of the tip portion, which is bent almost perpendicularly, does not preferably exceed a designed thickness of a mobile terminal in which the multiband antenna 10 is provided.

(Comparison Result of Radiation Patterns)

Figure 8:
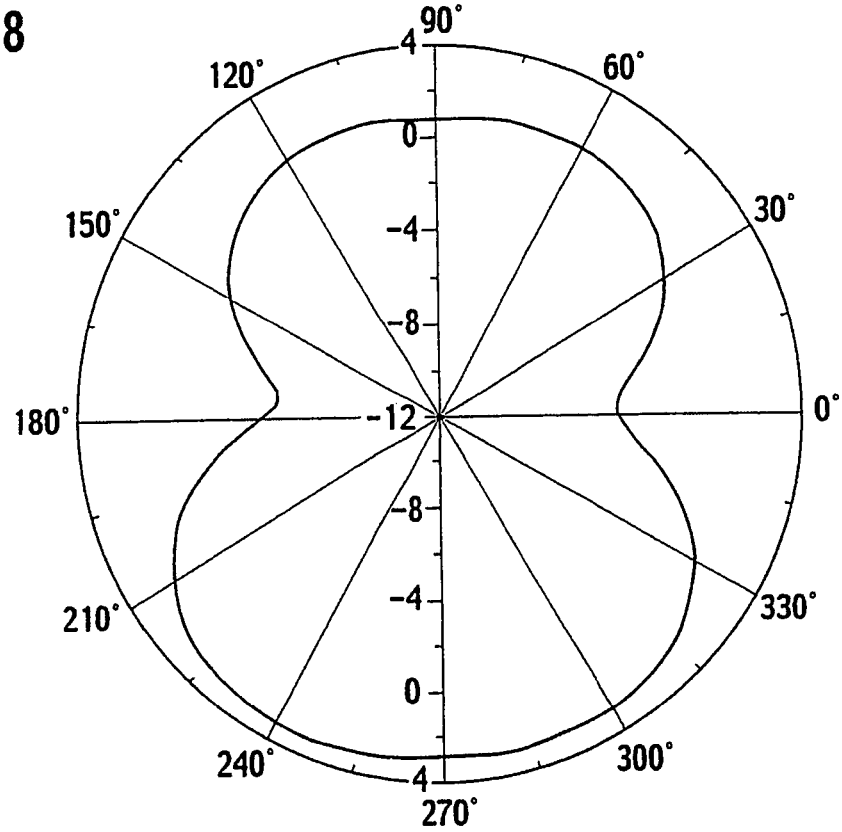
FIG. 8 is a graph showing a radiation pattern on a horizontal plane of the multiband antenna 130 according to the related art.
Figure 9:
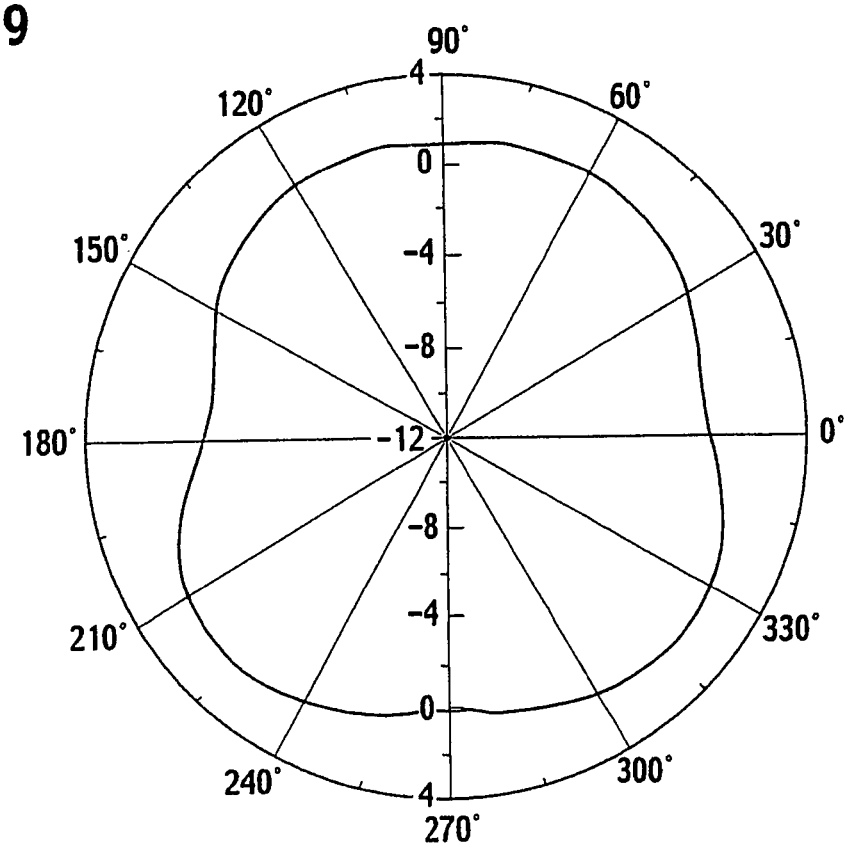
FIG. 9 is a graph showing a radiation pattern on a horizontal plane of the multiband antenna 10 according to the first embodiment.

A comparison result between a radiation pattern of a multiband antenna 130 according to the related art and a radiation pattern of the multiband antenna 10 according to the first embodiment will be described below with reference to the accompanying drawings. FIG. 8 is a graph showing the radiation pattern on a horizontal plane of the multiband antenna 130 (the element 132C) according to the related art. FIG. 9 is a graph showing the radiation pattern on a horizontal plane of the multiband antenna 10 (the element 13C) according to the first embodiment.

Figure 3:
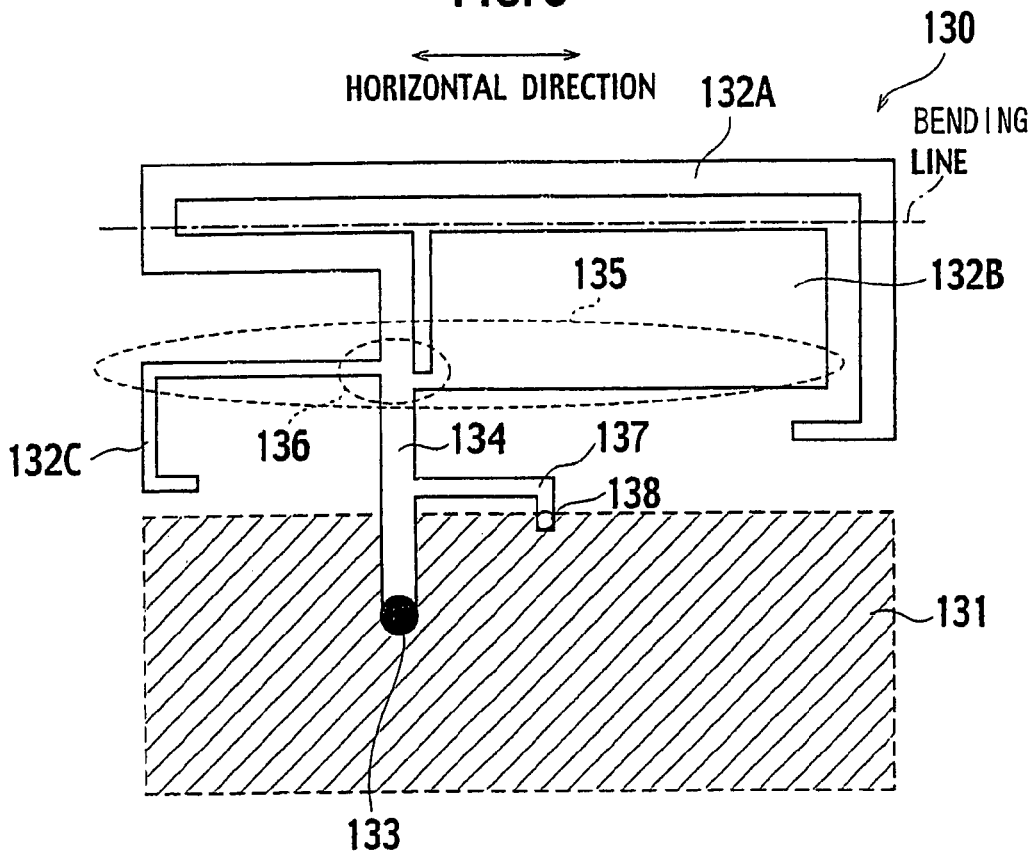
FIG. 3 is a view of a multiband antenna 130 according to the related art, which is viewed from a front surface side.
Figure 4:
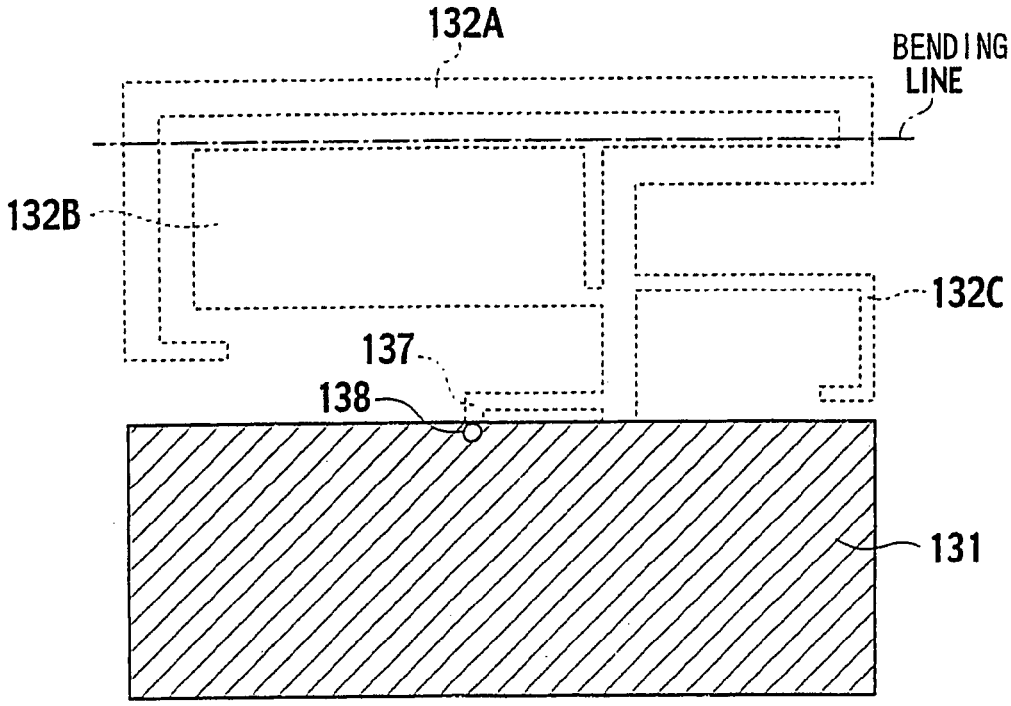
FIG. 4 is a view of the multiband antenna 130 according to the related art, which is viewed from a back surface side.

As shown in FIG. 3 and FIG. 4, the multiband antenna 130 according to the related art has the element 132A to the element 132C. Here, the element 132A to the element 132C are provided on one surface of the multiband antenna 130. For this reason, the element 132B and the element 132C are coupled to each other, and a high-order mode is excited.

Here, in terms of the element 132C (a frequency band corresponding to IMT2000, for example; 2100 MHz), the radiation pattern of the element 132C does not form a circle on the horizontal plane as shown in FIG. 8. To be more precise, the radiation pattern is deteriorated in the directions of 0° and 180° due to excitation in the high-order mode, whereby an omnidirectional characteristic of the element 132C in the horizontal plane is lost.

On the other hand, as shown in FIG. 5 to FIG. 7, the multiband antenna 10 according to the first embodiment has the element 13A to the element 13C. The element 13B is provided to the front surface side of the multiband antenna 10 while the element 13C is provided to the back surface side of the multiband antenna 10. Specifically, the element 13B and the element 13C are provided on mutually different surfaces of the multiband antenna 10. For this reason, coupling between the element 13B and the element 13C is suppressed, and excitation in the high-order mode is suppressed.

As similar to FIG. 8, in terms of the element 13C (a frequency band corresponding to IM2000, for example; 2100 MHz), the radiation pattern of the element 13C becomes almost circular on the horizontal plane as shown in FIG. 9. Specifically, according to the first embodiment, the radiation pattern is improved in comparison with the related art, and an omnidirectional characteristic of the element 13C in the horizontal plane is retained.

(Configuration of Multiband Antenna System)

Figure 10:
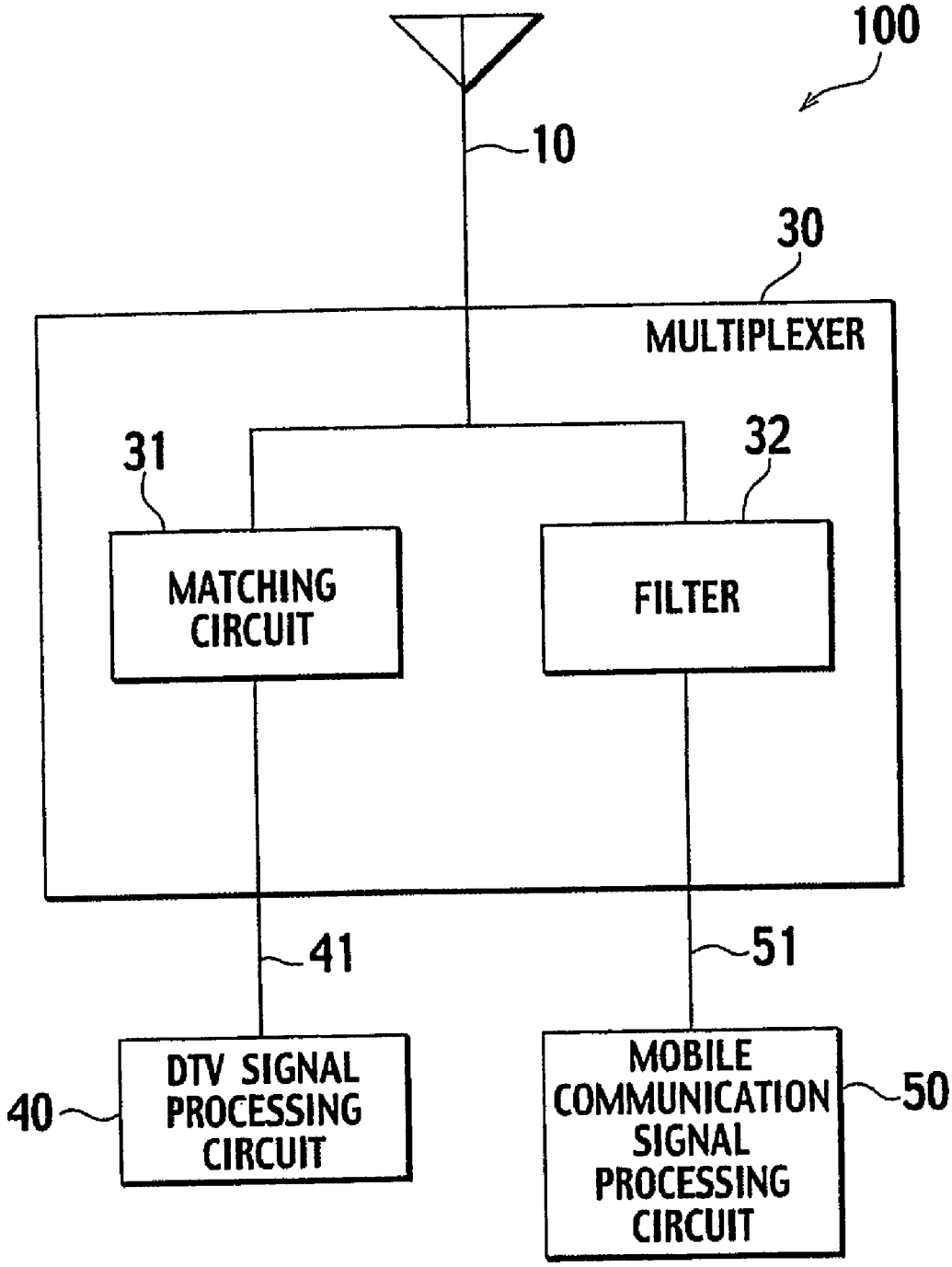
FIG. 10 is a view showing a multiband antenna system 100 according to the first embodiment.

A configuration of a multiband antenna system according to the first embodiment will be described below with reference to the accompanying drawing. FIG. 10 is a view showing a configuration of a multiband antenna system 100 according to the first embodiment.

As shown in FIG. 10, the multiband antenna system 100 has the multiband antenna 10 and a multiplexer 30. Here, it is to be noted that the multiband antenna 10 is designed to comply with frequencies for mobile communication. Note that, the frequencies for mobile communication is, for example, GSM frequencies (890 to 960 MHz), DCS frequencies (1710 to 1880 MHz), PCS frequencies (1850 to 1990 MHz), and IMT2000 frequencies (1710 to 2200 MHz).

Meanwhile, it is to be noted that the multiband antenna 10 is not designed to comply with frequencies for ground wave digital television (470 to 770 MHz). Specifically, since a size of the multiband antenna 10 is significantly small comparing with wavelengths of the ground wave digital television, an impedance corresponding to an electromagnetic radiation for the ground wave digital television is extremely small, and a reactance corresponding to the electromagnetic radiation for the ground wave digital television is extremely large.

The multiplexer 30 has a matching circuit 31 connected to a DTV signal processing circuit 40 and a filter 32 connected to a mobile communication signal processing circuit 50.

The matching circuit 31 adjusts an impedance/reactance ratio corresponding to the electromagnetic radiation for the ground wave digital television, and achieves matching between the impedance corresponding to the electromagnetic radiation for the ground wave digital television and impedance of a feed line 41. Note that, the matching circuit 31 may have a multiple-stage structure (such as a three-stage structure or a four-stage structure).

The filter 32 allows passage of the electromagnetic radiation for the mobile communication and guides the electromagnetic radiation to the mobile communication signal processing circuit 50. Here, the multiband antenna 10 is designed to comply with the frequencies for the mobile communication. Accordingly, it is to be noted that matching between the impedance corresponding to the electromagnetic radiation for the mobile communication and an impedance of a feed line 51 has been achieved already.

The DTV signal processing circuit 40 is a circuit configured to process the signal whose impedance matching has been achieved by the matching circuit 31.

The mobile communication signal processing circuit 50 is a circuit configured to process the signal that passes through the filter 32.

(Operation and Effects)

According to the multiband antenna 10 of the first embodiment, the front surface side elements (the element 13A and the element 13B) and the back surface side element (the element 13C) are provided on mutually different surfaces of the antenna portion 11. Therefore, even in a case where elements corresponding to the multiple resonance frequencies are provided, the coupling between the element 13B and the element 13C is suppressed, and the excitation in the high-order mode is suppressed.

Meanwhile, since the element is provided on the back surface side of the antenna portion 11, it is not necessary to strictly manage manufacturing errors of the multiband antenna 10. In this way, it is possible to suppress a drop in a yield rate of the multiband antenna 10.

The front surface side elements (the element 13A and the element 13B) and the back surface side element (the element 13C) share the feeding point 15. Accordingly, it is possible to simplify the configuration of the multiband antenna 10.

The element 13A and the element 13B share the common portion 16 while the back surface side element has the portion. 21 provided along the common portion 16. Accordingly, after designing layouts of the elements on the front surface of the antenna portion, it is necessary only to rearrange a part of the element on the back surface of the antenna portion. Therefore, it is possible to simplify the design of the multiband antenna 10.

By providing the short stub 14 that corresponds to the element 13A, it is possible to achieve matching between the impedance of the element 13A and the impedance of the feed line easily.

Since the tip portion of the antenna portion is bent almost perpendicularly, it is possible to attempt to downsize the multiband antenna 10. The height of the tip portion that is bent almost perpendicularly does not exceed the designed thickness of the mobile terminal. Accordingly, it is possible to prevent deterioration in appearance of the mobile terminal.

Other Embodiments

Although the present invention has been described with reference to the embodiment described above, it is not to be understood that the descriptions and the drawings constituting part of this disclosure will limit the scope of this invention. It is obvious to those skilled in the art that various alternative embodiments, examples, and technical applications are possible from this disclosure.

For example, although the single element is provided on the back surface side of the antenna portion 11 in the above-described embodiment, the present invention will not be limited only this configuration. To be more precise, multiple elements may be provided on the back surface side of the antenna portion 11. In this case, it is preferable that the multiple elements provided on the back surface side of the antenna portion 11 share the feeding point.

In the present application including the embodiment described above, note that a side provided with the element connected to the feeding point 15 is designated as the front surface side, and a side provided with the element connected to the ground plane 12 is designated as the back surface side.

The feeding point 15, the element 13A, the element 13B and the common portion 16 are provided on a surface of a substrate opposite to the ground plane 12, the present invention will not be limited only this configuration. To be more precise, the feeding point 15, the element 13A, the element 13B and the common portion 16 may be provide on a surface of the substrate identical to the ground plane 12, In this case, band gap having proper width for electrically separating the feeding point 15, the element 13A, the element 13B and the common portion 16 with the ground plane 12, will be provided.

What is claimed is:

1. A multiband antenna provided with an antenna portion having a front surface and a back surface, and a ground plane located adjacent to the antenna portion, comprising:

a front surface side element arranged on the front surface side, which is connected to a feeding point; and a back surface side element arranged on the back surface side, which is connected to the ground plane, wherein the front surface side element and the back surface side element share the feeding point.

2. A multiband antenna provided with an antenna portion having a front surface and a back surface, and a ground plane located adjacent to the antenna portion, comprising:

a front surface side element arranged on the front surface side, which is connected to a feeding point; and a back surface side element arranged on the back surface side, which is connected to the ground plane, wherein the front surface side element is formed of a plurality of elements sharing a common portion connected to the feeding point, the back surface side element has a portion provided along the common portion, and has a shape bent in a vicinity of a branching portion where the plurality of elements are branched off from the common portion.

3. A multiband antenna provided with an antenna portion having a front surface and a back surface, and a ground plane located adjacent to the antenna portion, comprising:

a front surface side element arranged on the front surface side, which is connected to a feeding point; and a back surface side element arranged on the back surface side, which is connected to the wound plane, wherein the front surface side element is formed of a plurality of elements sharing a common portion connected to the feeding point, and the multiband antenna further comprises a short stub branched off from the common portion and connected to the ground plane.

4. The multiband antenna according to claim 3, wherein the short stub is provided for achieving an impedance matching of the longest element out of the plurality of elements.

5. The multiband antenna as in one of claims 1 to 4, in which a tip portion of the antenna portion is bent.

6. A multiband antenna system comprising:

the multiband antenna according to one of claims 1 to 4; and a multiplexer configured to achieve an impedance matching corresponding to an electromagnetic radiation received by the multiband antenna.

* * * * *